United States Patent [19]

Moser

[11] 4,214,549

[45] Jul. 29, 1980

[54] ROLL FUSER APPARATUS AND RELEASE AGENT METERING SYSTEM THEREFOR

[75] Inventor: Rabin Moser, Fairport, N.Y.

[73] Assignee: Xerox Corporation, Stamford, Conn.

[21] Appl. No.: 920,110

[22] Filed: Jun. 28, 1978

[51] Int. Cl.[3] ..... G03C 13/20

[52] U.S. Cl. ..... 118/60; 118/117; 432/60; 432/228; 430/99

[58] Field of Search ..... 118/60, 117; 432/60, 432/228; 427/22

[56] References Cited

U.S. PATENT DOCUMENTS

| | | | |
|---|---|---|---|
| 3,878,818 | 4/1975 | Thettu et al. | 118/60 |
| 3,880,577 | 4/1975 | Tomono et al. | 432/228 |
| 3,929,094 | 12/1975 | Thettu | 118/60 |
| 3,964,431 | 6/1976 | Namiki | 432/60 |
| 4,079,229 | 3/1978 | Takiguchi | 432/60 |

*Primary Examiner*—Ralph S. Kendall

[57] ABSTRACT

A heat and pressure roll fusing apparatus for fixing toner images to copy substrates, the toner comprising a thermoplastic resin. The apparatus includes an internally heated, fuser roll cooperating with a backup or pressure roll to form a nip through which the copy substrates pass with the images contacting the heated roll. The heated fuser roll is characterized by an outer layer or surface which by way of example is fabricated from a silicon rubber or Viton material to which a low viscosity polymeric release fluid is applied. Release fluid is contained in a sump from which it is dispensed by means of a metering roll and a donor roll, the former of which contacts the release fluid in the sump and the latter of which contacts the surface of the heated fuser roll.

4 Claims, 1 Drawing Figure

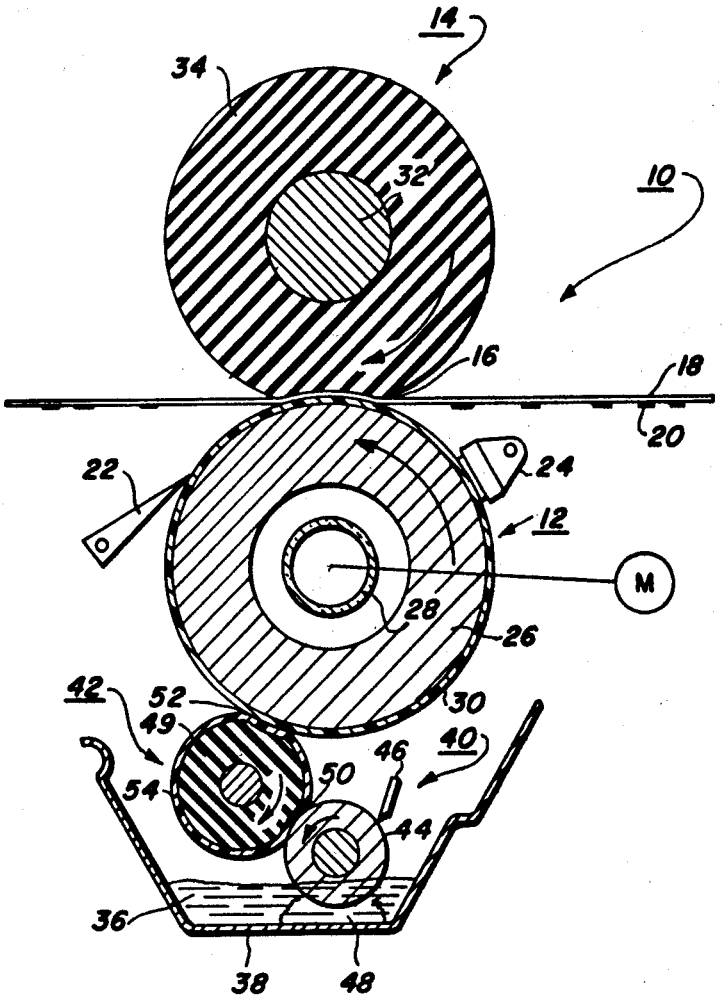
14
34
32
10
16
18
20
22
24
12
M
28
26
42
52
49
30
40
46
54
50
44
36
38
48

ROLL FUSER APPARATUS AND RELEASE AGENT METERING SYSTEM THEREFOR

BACKGROUND OF THE INVENTION

This invention relates generally to xerographic copying methods and apparatus, and more particularly, it relates to the heat and pressure fixing of particulate thermoplastic toner by direct contact with a heated fusing member having a release fluid on the surface thereof.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperture of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recorcing arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner liquify and cause a splitting action in the molten toner resulting in "hot offset". Splitting occurs when the cohesive forces holding the viscous toner mass together is less than the adhesive forces tending to offset it to a contacting surface such as a fuser roll.

Occasionally, however, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the foregoing problems, particularly that which is commonly referred to as "offsetting", has been to provide a fuser roll with an outer surface or covering of polytetrafluoroethylene, known by the trade name, Teflon to which a release agent such as silicone oil is applied, the thickness of the Teflon being on the order of several mils and the thickness of the oil being less than 1 micron. Silicone based oils, (polydimethylsiloxane), which possess a relatively low surface energy, have been found to be materials that are suitable for use in the heated fuser roll environment where Teflon con-stitutes the outer surface of the fuser roll. In practice, a thin layer of silicone oil is applied to the surface of the heated roll to form an interface between the roll surface and the toner images carried on the support material. Thus, a low surface energy layer is presented to the toner as it passes through the fuser nip and thereby prevents toner from offsetting to the fuser roll surface.

A fuser roll construction of the type described above is fabricated by applying in any suitable manner a solid layer of adhesive material to a rigid core or substrate such as the solid Teflon outer surface or covering of the aforementioned arrangement.

In attempts to improve at least the perceived quality of the image fused or fixed by a heated roll fuser, such rolls have been provided with conformable surfaces comprising silicone rubber or Viton (Trademark of E. I. duPont for a series of fluoroelastomers based on the copolymer of vinylidene fluoride and hexafluoropropylene). As in the case of the Teflon coated fuser roll release fluids such as silicone based oils have been applied to the surface of the silicone rubber or Viton to both minimize offsetting and to facilitate stripping. See, for example, U.S. Pat. No. 3,964,431. When the fuser system is one which provides for applying silicone oil to silicone rubber or Viton a low viscosity silicone oil (i.e. on the order of 100–1000cs) has most commonly been employed.

Most recently, functional silicone oils (i.e. oils that chemically interact with metallic or metal containing surfaces) have been discovered for use as release coatings on fuser rolls. These materials are considered to be less thermally stable than the conventional non-functional silicone oils and therefore necessitate certain precautions in their handling, particularly, in the standby mode of operation. For example, it has been found that the conventional methods (i.e. fuser roll contacts release material in a sump with subsequent metering with a blade) of applying functional release materials to heated fuser rolls shortens the life of these types of release agent materials.

BRIEF SUMMARY OF THE INVENTION

Accordingly, it is the purpose of the present invention to minimize heating of the functional release fluid and to effectively provide for metering of a proper amount of release fluid to the surface of a heated fuser roll by the utilization of a metering blade.

In order to maintain optimum blade metering it is desirable that the roll to which the release material is to be metered comprise a smooth surfaced material such as metal. However, a metal roll represents a substantial heat transfer vehicle which does not provide for sufficient thermal isolation of the release agent from the hot fuser roll, such isolation being required due to the thermal instability of the release agent material.

Therefore, a doner roll fabricated from a highly insulative and deformable material, for example, silicone rubber, is provided for transferring release material from a metering roll contacting the release material contained in a sump to the fuser roll. As will be appreciated, such an arrangement of a metering roll and a donor roll results in the remote positioning of the fuser roll from the release agent fluid or material along with the provision of an effective thermal barrier therebetween.

In order to effect transfer between the fuser roll and the doner roll and between the donor roll and the metering roll, a force is exerted between the rolls such that the donor roll is deformed to thereby form a nip between each pair of rolls. In addition to effecting release agent transfer, the nip formation also enables driving of the donor roll and, in turn, the metering roll through the rotation of the fuser roll.

It has been observed that a certain amount of lint and other contamination can be transferred from the fuser roll into the sump of release fluid by the donor and metering rolls. Consequently, it may be desirable under certain operating conditions to provide the silicone rubber donor roll with a thin sleeve of adhesive material, for example, a copolymer of perfluorovalkyl perfluorovinyl ether with tetrafluoroethylene wherein the ether has the formula $C_nF_{2n+1}$—O—CF = $CF_2$ where n is a number from 1–5 inclusive, commonly referred to as PFA which serves to minimize the transfer of contaminants from the fuser roll to the donor roll and then to the release agent.

Even though the metering roll is partially submerged in the release fluid, an air layer at the surface of the metering roll would result due to the rotation of the metering roll and would preclude contact between the roll surface and the fluid. Accordingly, an air seal in the form of a wick is submerged in the release agent material and contacts the surface of the metering roll. The wick insures contact of the rotating metering roll with the release agent because it prevents buildup of such an air layer beyond the point of contact, in the direction of rotation of the metering roll, between the roll and the wick.

DESCRIPTION OF THE DRAWING

The FIGURE is a side elevational schematic view of a roll fuser apparatus and release agent applying mechanism therefor.

DETAILED DESCRIPTION OF THE PREFERRED EMBODIMENT OF THE INVENTION

Referring now to the FIGURE, it can be seen that the invention is directed to a roll fuser apparatus generally indicated 10. The fuser apparatus comprises a heated roll structure 12 cooperating with a non-heated backup roll structure 14 to form a nip 16 through which a copy substrate 18 passes with toner images 20 formed thereon in a well known manner. The toner images 20 contact the heated roll structure while a force is applied between the roll structure in a well known manner to create pressure therebetween resulting in the deformation of the backup roll structure by the heated roll structure to thereby form the nip 16.

As the substrate passes out of the nip, it is stripped from the heated roll structure by a plurality (only one shown) of air stripping devices 22 after which it is free to move along a predetermined path toward the exit of the machine (not shown) in which the fuser apparatus 10 is to be utilized.

A contact temperature sensor 24 is provided for sensing the surface temperature of the roll structure 12 and in conjunction with conventional circuitry (not shown) maintains the surface temperature to a predetermined value, for example, on the order of 375–400° F.

The heated roll structure 12 comprises a hollow cylinder 26 having a radiant quartz heater 28 disposed in the hollow thereof. When suitably energized via the aformentioned circuitry, the heating element radiates heat to the cylinder which is then conducted to the outer surface of an outer layer 30 of the structure 12 which preferably comprises Viton having a thickness of 0.008 in.

The backup roll structure 14 comprises a solid metal core 32 to which is adhered a relatively thick layer 34 of deformable material for example an elastomer known as ethylene-propylene terpolymer which is based on stereosperific linear typolymers of ethylene, propylene and small amounts of non-conjugated diene which is commonly referred to as EPDM which layer carries a thin overcoat of PFA. Due to the construction of the backup roll structure it is deformed by the harder heated roll structure when the required pressure is applied therebetween, the pressure being a function of the desired deformation which corresponds to the desired length of the nip 16.

While the layer 30 tends to be adhesive, therefore, exhibits a low affinity for the toner material 20, it has been found desirable to coat the layer with a release agent material 36 contained in a sump 38. The material 36 comprises a polymeric release agent having functional groups such as carboxy, hydroxy, epoxy, ammo, isogenate, thioether or mercepto groups.

For the purpose of coating the heated roll structure 12 there is provided a release agent applying mechanism generally indicated 40. The mechanism 40 comprises a donor roll 42, metering roll 44, doctor blade 46 and a wick 48.

The metering roll 44 is partially immersed in the release agent material 36 and is supported for rotation such that it is contacted by the donor roll 42 which, in turn, is supported so as to be contacted by the heated roll structure 12. As can be seen, the orientation of the rolls 42 and 44 is such as to provide a path for conveying material 36 from the sump to the surface of the heated roll structure 12. The metering roll is preferably a steel-surfaced roll having a 4-32 AA finish. The metering roll has an outside diameter of 0.75 inch. As mentioned above, the metering roll is supported for rotation, such rotation being derived by means of the positively driven heated roll structure 12 via the rotatably supported donor roll 42. In order to permit rotation of (at a practical input torque to the heated roll structure 12) of the metering roll 44 in this manner the donor roll 42 comprises a deformable layer 4) which forms a first nip 50 between the metering roll and the donor roll and a second nip 52 between the latter and the heated roll. The nips 50 and 52 also permit satisfactory release agent transfer between the rolls and roll structure. Suitable nip lengths are 0.10 inch.

A wick 48 is fully immersed in the release agent and contacts the surface of the metering roll 44. The purpose of the wick is to provide an air seal which disturbs the air layer formed at the surface of the roll 44 during rotation thereof. If it were not for the function of the wick, the air layer would be coextensive with the surface of the roll immersed in the release agent thereby precluding contact between the metering roll and the release agent.

The wiper blade 46 preferably fabricated from Viton is $\frac{3}{4} \times \frac{1}{8}$in cross section and has a length coextensive with the metering roll. The edge of the blade contacting the metering roll has a radius of 0.001–0.010 inch. The blade functions to meter the release agent picked up by the roll 44 to a predetermined thickness, such thickness being of such a magnitude as to result in several microliters of release agent consumption per copy.

The donor roll 42 has an outside diameter of 0.813 inch when the metering roll's outside diameter equals 0.75 inch. It will be appreciated that other dimensional combinations will yield satisfactory results. For example, 1.5 inch diameter rolls for the donor and metering rolls have been employed. The deformable layer 49 of the donor roll preferably comprises silicone rubber. However, other materials may also be employed.

A thin sleeve 54 on the order of several mils, constitutes the outermost surface of the roll 42, the sleeve material comprises Teflon. While the donor rolls may be employed without the sleeve 54, it has been found that when the sleeve is utilized, contaminants such as lint on the heated roll 12 will not readily transfer to the metering roll 44. Accordingly, the material in the sump will not become contaminated by such contaiminants.

I claim:

1. In a contact fuser apparatus having a heated roll structure cooperating with a backup roll structure to form a nip through which copy substrates carrying toner images pass with said toner images contacting the heated fuser roll, wherein a release agent contained in a sump is applied to the surface of the heated roll structure to minimize offset of toner thereto and facilitate separation of the substrate from the heated fuser roll, the improvement comprising a rotatably supported donor roll contacting said heated roll structure and a smooth metal-surfaced rotatably supported metering roll supported for contact with said donor roll and said release agent in said sump, and a metering blade contacting said metering roll for metering said release agent to a predetermined thickness thereon, said donor roll comprising a deformable surface capable of having a pair of nips formed therein through pressure contact with said heated roll structure and said metering roll, and further comprising means coupled to said heated roll structure for effecting rotation of said structure and, in turn, rotation of said rolls by said heated roll structure.

2. Apparatus according to claim 1 wherein said heated roll structure comprises a copolymer of vinylidene fluoride and hexafluoropropylene covering said roll structure.

3. Apparatus according to claim 2 wherein said donor roll comprises a thin outer sleeve of a copolymer of perfluoroalkyl perfluorovinyl ether with tetrafluoroethylene.

4. Apparatus according to claim 3 wherein said release agent comprises a functional silicone oil.

* * * * *